US010580608B2

(12) United States Patent
Bunk et al.

(10) Patent No.: US 10,580,608 B2
(45) Date of Patent: Mar. 3, 2020

(54) BREAKER MECHANISM FOR AN ELECTRICAL CIRCUIT BREAKER AND ELECTRICAL CIRCUIT BREAKER WITH SUCH A BREAKER MECHANISM

(71) Applicant: Siemens Aktiengesellschaft, Munich (DE)

(72) Inventors: Thomas Bunk, Sulzbach-Rosenberg (DE); Siegfried Pirker, Hohenburg (DE); Johannes Welzl, Birgland (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/666,608

(22) Filed: Aug. 2, 2017

(65) Prior Publication Data

US 2018/0068819 A1 Mar. 8, 2018

(30) Foreign Application Priority Data

Sep. 8, 2016 (DE) ..... 10 2016 217 106

(51) Int. Cl.
*H01H 71/50* (2006.01)
*H01H 71/52* (2006.01)
(Continued)

(52) U.S. Cl.
CPC ..... *H01H 71/505* (2013.01); *H01H 1/2041* (2013.01); *H01H 1/2058* (2013.01);
(Continued)

(58) Field of Classification Search
CPC ..... H01H 71/505; H01H 71/525; H01H 5/16; H01H 5/045; H01H 3/3026; H01H 1/2058;
(Continued)

(56) References Cited

U.S. PATENT DOCUMENTS 4,736,174 A 4/1988 Castonguay et al.
5,357,066 A 10/1994 Morel et al.
(Continued)

FOREIGN PATENT DOCUMENTS

| | | |
|---|---|---|
| CN | 1086629 A | 5/1994 |
| DE | 4442417 C1 | 2/1996 |
| EP | 1039499 A2 | 9/2000 |
| ZA | 9901853 B | 9/1999 |

OTHER PUBLICATIONS

Extended European Search Report dated Jan. 19, 2018.
German Office Action 2016P18295 DE dated Jul. 12, 2017.
Office Action for Chinese Patent Application No. 201710794876.1 dated Sep. 4, 2018.

*Primary Examiner* — Edwin A. Leon
*Assistant Examiner* — Lheiren Mae A Caroc
(74) *Attorney, Agent, or Firm* — Harness, Dickey & Pierce, P.L.C.

(57) ABSTRACT

A breaker mechanism for an electrical circuit breaker is disclosed, the breaker mechanism including a spring, a latching mechanism and an actuating element, with which a breaker shaft of the electrical circuit breaker is actuated for breaking (OFF position) or making (ON position) the electric current. In an embodiment, the actuating element is actuated in the direction of the ON position when making the electric current, and the spring is thereby tensioned. Further, the latching mechanism releases the energy of the spring for actuating the breaker shaft of the electrical circuit breaker when the ON position is reached.

17 Claims, 3 Drawing Sheets

(51) Int. Cl.

| | |
|---|---|
| ***H01H 3/30*** | (2006.01) |
| ***H01H 5/04*** | (2006.01) |
| ***H01H 5/16*** | (2006.01) |
| ***H01H 1/50*** | (2006.01) |
| ***H01H 1/20*** | (2006.01) |

(52) U.S. Cl.
CPC ..... *H01H 1/50* (2013.01); *H01H 3/3026* (2013.01); *H01H 5/045* (2013.01); *H01H 5/16* (2013.01); *H01H 71/52* (2013.01); *H01H 71/525* (2013.01); *H01H 2235/01* (2013.01)

(58) Field of Classification Search
CPC ..... H01H 1/2041; H01H 71/52; H01H 1/50; H01H 2235/01
USPC ..... 200/401, 425, 321, 323, 325
See application file for complete search history.

(56) References Cited

U.S. PATENT DOCUMENTS

| | | | | |
|---|---|---|---|---|
| 5,369,384 | A | 11/1994 | Heins | |
| 5,918,732 | A | 7/1999 | Zabrocki et al. | |
| 5,931,289 | A | 8/1999 | Chou | |
| 6,911,614 | B2 * | 6/2005 | Asano | H01H 71/501 200/401 |
| 7,009,129 | B2 * | 3/2006 | Vierling | H01H 71/526 200/400 |
| 8,420,968 | B2 * | 4/2013 | Park | H01H 71/501 200/335 |

* cited by examiner

BREAKER MECHANISM FOR AN ELECTRICAL CIRCUIT BREAKER AND ELECTRICAL CIRCUIT BREAKER WITH SUCH A BREAKER MECHANISM

PRIORITY STATEMENT

The present application hereby claims priority under 35 U.S.C. § 119 to German patent application number DE 102016217106.2 filed Sep. 8, 2016, the entire contents of which are hereby incorporated herein by reference.

FIELD

At least one embodiment of the invention generally relates to a breaker mechanism for an electrical circuit breaker and/or to an electrical circuit breaker with such a breaker mechanism.

BACKGROUND

Due to the ever-increasing requirements that power circuit breakers have to meet with respect to the overall size, current carrying capacity, etc., the requirements for the internal mechanisms are also becoming increasingly demanding. For this reason, a physical limit in component design, especially with respect to the breaker mechanism, has been reached as a result of the high spring force that is required for switching the contacts and producing the contact force and the angle of resilience.

It has so far been the case in breaker mechanisms that the energy is built up until the switching point of the breaker mechanism is reached. At the switching point, the turning of the breaker shaft for opening or closing the electrical circuit breaker begins.

In order that the components undergo as little mechanical stress as possible, in this invention the maximum amount of stored energy is used for actuating the breaker mechanism.

SUMMARY

At least one embodiment of the invention is directed to a breaker mechanism for an electrical circuit breaker that uses as much stored energy as possible for actuating the breaker shaft.

At least one embodiment is achieved according to the invention by the breaker mechanism for an electrical circuit breaker. Advantageous refinements of the breaker mechanism according to the invention are specified in claims. At least one embodiment of the invention is directed to an electrical circuit breaker. Advantageous refinements of the electrical circuit breaker are specified in claims.

The breaker mechanism for an electrical circuit breaker of at least one embodiment includes a spring, a latching mechanism and an actuating element, with which a breaker shaft of the electrical circuit breaker is actuated for breaking (OFF position) or making (ON position) the electric current, the actuating element being actuated in the direction of the ON position when making the electric current, and the spring thereby tensioned, and the latching mechanism releasing the energy of the spring for actuating the breaker shaft of the electrical circuit breaker when the ON position is reached.

At least one embodiment of the invention is further directed to an electrical circuit breaker, which comprises a breaker mechanism according to at least one embodiment of the invention and a breaker shaft, the breaker shaft being actuable by the energy of the spring.

BRIEF DESCRIPTION OF THE DRAWINGS

The properties, features and advantages of this invention that are described above and the manner in which they are achieved become clearer and more easily understandable in connection with the following description of the example embodiments, which are explained in more detail in conjunction with the figures, in which.

DETAILED DESCRIPTION OF THE EXAMPLE EMBODIMENTS

Figure 1:
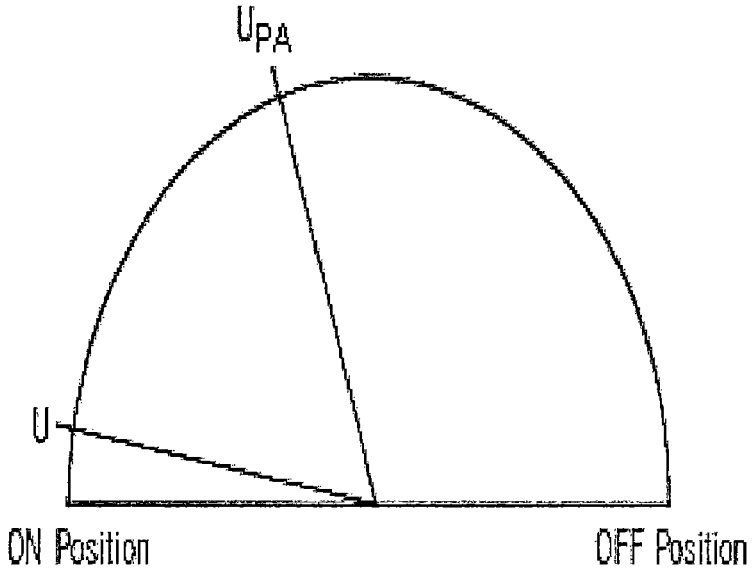
FIG. 1 shows a switching point in the prior art and a switching point according to an embodiment of the invention between the ON position and the OFF position.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The breaker mechanism for an electrical circuit breaker of at least one embodiment includes a spring, a latching mechanism and an actuating element, with which a breaker shaft of the electrical circuit breaker is actuated for breaking (OFF position) or making (ON position) the electric current, the actuating element being actuated in the direction of the ON position when making the electric current, and the spring thereby tensioned, and the latching mechanism releasing the energy of the spring for actuating the breaker shaft of the electrical circuit breaker when the ON position is reached.

It is advantageous here, in at least one embodiment, that the maximum energy content of the spring is used. The latching has the effect that the spring is deflected to the maximum and the maximum amount of energy is transferred to the breaker shaft. In the case of customary breaker mechanisms, the energy of the spring is already released at about 70%. Not only the energy of the spring but also the greater lever arm from the sliding axis to the spring axis is advantageously used, whereby a much greater torque is applied to the breaker shaft.

It is similarly advantageous, in at least one embodiment, that no friction-induced fluctuations occur at the switching point of the mechanism. The switching point is also independent of the actuating speed of the actuating element. The latching mechanism has the effect that the release is not determined by an equilibrium of forces, which is adversely affected by external influences.

It is also advantageous, in at least one embodiment, that the breaker mechanism can be implemented in a small overall space. The maximum use of the spring energy allows the spring to be designed as smaller, and consequently more affordable and more mechanically stable. The increase in the contact-making reliability is similarly advantageous. The defined amount of energy, which is not subject to any fluctuations due to external influences, means that there is closer coordination between the breaker mechanism and the breaker shaft.

In at least one embodiment, the actuating element is formed as a toggle lever or as a rotary lever.

In a further embodiment, the latching mechanism is activated by being contacted by the actuating element.

At least one embodiment of the invention is further directed to an electrical circuit breaker, which comprises a breaker mechanism according to at least one embodiment of the invention and a breaker shaft, the breaker shaft being actuable by the energy of the spring.

In at least one embodiment of the electrical circuit breaker, when reaching the ON position, the latching mechanism releases the energy of the spring for actuating the breaker shaft of the electrical circuit breaker and the breaker shaft brings at least one moving contact into mechanical contact with a fixed contact.

In a further embodiment, the electrical circuit breaker is formed as a power circuit breaker.

Figure 3:
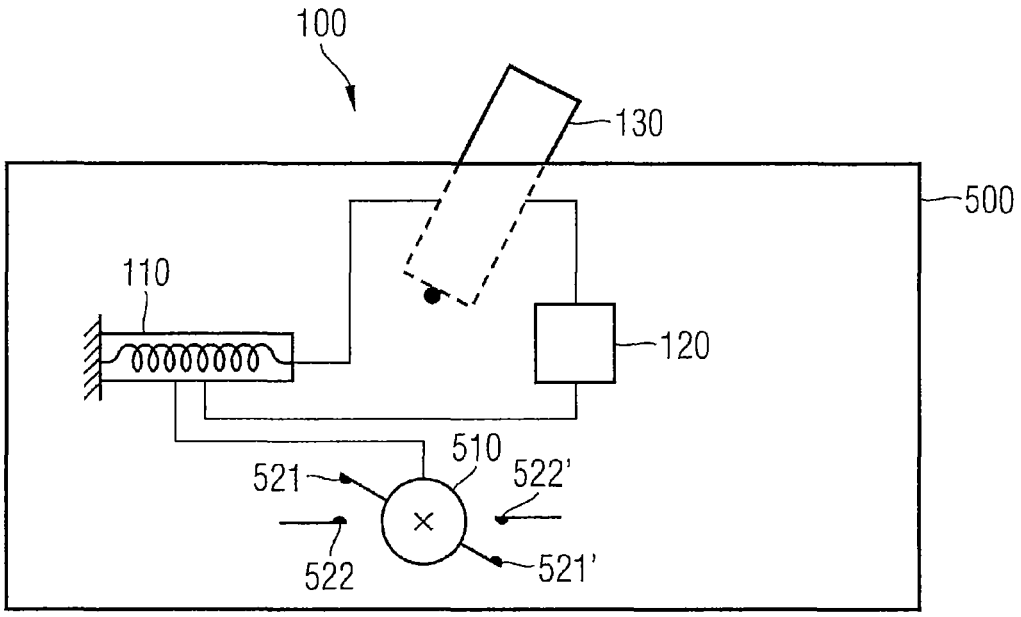
FIG. 3 shows an electrical circuit breaker with the breaker mechanism according to an embodiment of the invention.

In FIG. 3, an electrical circuit breaker 500 with a breaker mechanism 100 is shown. The electrical circuit breaker 500 comprises a breaker shaft 510, which is connected to electrical contacts. For example, these may be moving contacts 521, 521' and fixed contacts 522, 522'. The turning of the breaker shaft 510 allows the electrical contacts 521, 521'; 522, 522' to open or close the electrical circuit breaker 500.

The breaker mechanism 100 also comprises an actuating element 130. This may be for example a toggle lever 130. It is similarly conceivable that the actuating element 130 is formed as a rotary lever.

The breaker mechanism 100 also comprises a spring 110 and a latching mechanism 120. The procedure by which the breaker shaft 510 of the electrical circuit breaker 500 is actuated by the actuating element 130 for breaking (OFF position) or making (ON position) the electric current is further explained below.

When making the electric current, i.e. actuating the actuating element 130 in the direction of the ON position, the spring 110 is tensioned. The spring 110 serves as an energy store and, on account of the latching mechanism 120, cannot yet deliver this energy to the breaker shaft 510 of the electrical circuit breaker 500. Only when the ON position is reached does the latching mechanism 120 release the energy of the spring 110 for actuating the breaker shaft 510 of the electrical circuit breaker 500.

In FIG. 1, the switching point U of the breaker mechanism 100 according to an embodiment of the invention is shown. In this respect, the semicircular path from the OFF position to the ON position is shown for a toggle lever 130. The toggle lever 130 is moved in the direction of the ON position, and thereby tensions the spring 110. At the switching point U of the energy store or of the spring 110, the energy is released for actuating the breaker shaft 510.

In FIG. 1, a typical switching point UPA, as it is known from the prior art, is shown. Typically, this switching point lies at 70% of the path of the toggle lever 130 between the OFF position and the ON position. The fact that the prior-art switching point UPA lies at 70% means that no further energy is built up in the spring 110 of the electrical circuit breaker 500 by the movement further in the direction of the ON position. It is therefore advantageous in the case of the breaker mechanism 100 according to an embodiment of the invention that the switching point U is arranged directly at the ON position and the entire path of the toggle lever 130 is used for the tensioning of the spring 110.

The switching, that is to say the release of the energy of the spring 110 for actuating the breaker shaft 510 of the electrical circuit breaker 500, is activated by the actuating element 130 or the toggle lever 130 coming into contact with the latching mechanism 120. The mechanical contact of the toggle lever 130 with the latching mechanism 120 brings about the activation of the latching mechanism 120, and consequently an actuation of the breaker shaft 510.

Figure 2:
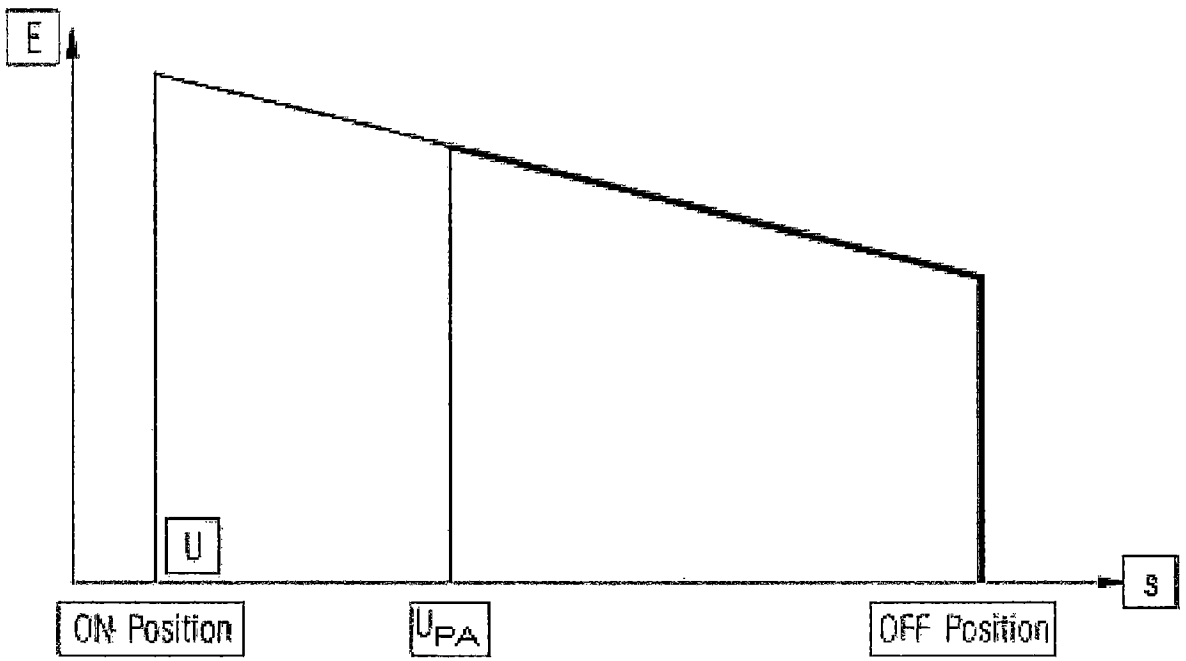
FIG. 2 shows a simplified representation of the energy over the path of the actuating element.

In FIG. 2, the energy stored in the spring 110 is plotted against the path of the toggle lever 130. Beginning from the OFF position, energy is built up in the spring 110 by the actuation of the toggle lever 130 in the direction of the ON position. In the prior art, the switching point UPA, which releases the actuation of the breaker shaft 510, is reached at about 70% of the path of the toggle lever 130. The breaker mechanism 100 according to an embodiment of the invention has the effect that the switching point U is shifted toward the ON position. As a result, the path up to the ON position is similarly used for storing energy in the spring 110, that is to say for tensioning the spring. Altogether, more energy can be stored in the spring 110 with the breaker mechanism 100 according to an embodiment of the invention.

The breaker mechanism 100 according to an embodiment of the invention has the effect that the maximum energy content of the spring 110 is used. The latching mechanism 120 causes the spring 110 to be deflected to the maximum and the maximum amount of energy to be transferred to the breaker shaft 510 of the electrical circuit breaker 500. In the case of conventional toggle-lever breaker mechanisms, this energy is already released at about 70%.

The release of the energy of the spring 110 is determined by the latching mechanism 120 and not by an equilibrium of forces, which is subject to external influences and is adversely affected by them. Consequently, the breaker mechanism 100 according to an embodiment of the invention has no friction-induced or speed-induced fluctuations at the switching point.

The fact that the spring 110 is used to the maximum in terms of its energy allows the spring to be designed as smaller, and consequently more affordable and more mechanically stable.

The defined amount of energy, which is not subject to any fluctuations due to external influences, means that closer coordination between the breaker mechanism and the breaker shaft is possible.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A breaker mechanism for an electrical circuit breaker, the breaker mechanism comprising:

a spring;

a latching mechanism; and an actuating element, configured to actuate a breaker shaft of the electrical circuit breaker for breaking, in an OFF position, or making, in an ON position, contact for electric current, the actuating element being configured to be actuated in a direction of the ON position when making contact for the electric current, and thereby tension the spring, and the latching mechanism being configured to release energy of the spring to actuate the breaker shaft of the electrical circuit breaker when the ON position is reached by the actuating element, wherein the latching mechanism is configured to be activated by coming into direct mechanical contact with the actuating element, wherein the spring is tensioned to its maximum amount and the latching mechanism is configured to release the energy of the spring to actuate the breaker shaft of the electrical circuit breaker only when the ON position is reached by the actuating element.

2. The breaker mechanism of claim 1, wherein the actuating element is formed as a toggle lever or as a rotary lever.

3. An electrical circuit breaker comprising:

the breaker mechanism of claim 2; and a breaker shaft, the breaker shaft being actuatable by the energy of the spring.

4. The electrical circuit breaker of claim 3, wherein, in response to the actuating element reaching the ON position, the latching mechanism is configured to release the energy of the spring to actuate the breaker shaft of the electrical circuit breaker and the breaker shaft is configured to bring at least one moving contact into mechanical contact with a fixed contact.

5. The electrical circuit breaker of claim 4, wherein the electrical circuit breaker is formed as a power circuit breaker.

6. The electrical circuit breaker of claim 3, wherein the electrical circuit breaker is formed as a power circuit breaker.

7. An electrical circuit breaker comprising:

the breaker mechanism of claim 1; and a breaker shaft, the breaker shaft being actuatable by the energy of the spring.

8. The electrical circuit breaker of claim 7, wherein, in response to the actuating element reaching the ON position, the latching mechanism is configured to release the energy of the spring to actuate the breaker shaft of the electrical circuit breaker and the breaker shaft is configured to bring at least one moving contact into mechanical contact with a fixed contact.

9. The electrical circuit breaker of claim 8, wherein the electrical circuit breaker is formed as a power circuit breaker.

10. The electrical circuit breaker of claim 7, wherein the electrical circuit breaker is formed as a power circuit breaker.

11. An electrical circuit breaker comprising:

the breaker mechanism of claim 1; and a breaker shaft, the breaker shaft being actuatable by the energy of the spring.

12. The electrical circuit breaker of claim 11, wherein, in response to the actuating element reaching the ON position, the latching mechanism is configured to release the energy of the spring to actuate the breaker shaft of the electrical circuit breaker and the breaker shaft is configured to bring at least one moving contact into mechanical contact with a fixed contact.

13. The electrical circuit breaker of claim 12, wherein the electrical circuit breaker is formed as a power circuit breaker.

14. The electrical circuit breaker of claim 11, wherein the electrical circuit breaker is formed as a power circuit breaker.

15. The breaker mechanism of claim 1, wherein a switching point of the breaker mechanism is arranged directly at the ON position.

16. The breaker mechanism of claim 1, wherein the actuating element is configured to travel a path from an OFF position to the ON position to reach its switching point and the actuating element travels the entire path when tensioning the spring to the switching point.

17. A breaker mechanism for an electrical circuit breaker, the breaker mechanism comprising:

a spring;

a latching mechanism; and an actuating element, configured to actuate a breaker shaft of the electrical circuit breaker for breaking, in an OFF position, or making, in an ON position, contact for electric current, the actuating element being configured to be actuated in a direction of the ON position when making contact for the electric current, and thereby tension the spring, and the latching mechanism being configured to release energy of the spring to actuate the breaker shaft of the electrical circuit breaker when the ON position is reached by the actuating element, wherein the actuating element is configured to travel a path from an OFF position to the ON position to reach its switching point and the actuating element travels the entire path when tensioning the spring to the switching point.

* * * * *